US008943974B1

(12) United States Patent
Gold et al.

(10) Patent No.: US 8,943,974 B1
(45) Date of Patent: Feb. 3, 2015

(54) WALL BREACHING FRAGMENTATION PROJECTILE

(71) Applicants: Vladimir M. Gold, Hillside, NJ (US); William J. Poulos, Park Ridge, NJ (US)

(72) Inventors: Vladimir M. Gold, Hillside, NJ (US); William J. Poulos, Park Ridge, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 125 days.

(21) Appl. No.: 13/719,364

(22) Filed: Dec. 19, 2012

(51) Int. Cl.

| | |
|---|---|
| ***F42B 12/32*** | (2006.01) |
| ***F42B 22/00*** | (2006.01) |
| ***F42B 12/08*** | (2006.01) |
| ***F42B 14/02*** | (2006.01) |
| ***F42B 12/22*** | (2006.01) |
| ***F42B 12/04*** | (2006.01) |
| ***F42B 12/20*** | (2006.01) |
| ***F42B 39/20*** | (2006.01) |
| ***F42C 11/04*** | (2006.01) |

(52) U.S. Cl.

CPC ..... *F42B 12/22* (2013.01); *F42B 12/04* (2013.01); *F42B 14/02* (2013.01); *F42B 12/204* (2013.01); *F42B 39/20* (2013.01); *F42C 11/04* (2013.01)

USPC ..... 102/497; 102/389; 102/519; 102/527

(58) Field of Classification Search

USPC ..... 102/389, 473, 491, 494, 496, 497, 519, 102/527

See application file for complete search history.

(56) References Cited

U.S. PATENT DOCUMENTS

| | | | | | |
|---|---|---|---|---|---|
| 3,498,224 | A * | 3/1970 | Cordle et al. | ..... | 102/496 |
| 3,744,426 | A * | 7/1973 | Butler | ..... | 102/527 |
| 4,065,753 | A * | 12/1977 | Paul, Jr. | ..... | 340/10.42 |
| 4,404,912 | A * | 9/1983 | Sindermann | ..... | 102/505 |
| 4,558,646 | A * | 12/1985 | Hoffmann et al. | ..... | 102/527 |
| 4,739,709 | A * | 4/1988 | Zimmerschied | ..... | 102/497 |
| 5,166,471 | A * | 11/1992 | Maselli et al. | ..... | 102/496 |
| H1235 | H * | 10/1993 | Canaday | ..... | 102/334 |
| 5,661,254 | A * | 8/1997 | Steuer et al. | ..... | 89/1.815 |
| 5,939,662 | A * | 8/1999 | Bootes et al. | ..... | 102/473 |
| 7,451,704 | B1 * | 11/2008 | Gold et al. | ..... | 102/495 |
| 8,272,329 | B1 * | 9/2012 | Hsieh et al. | ..... | 102/491 |
| 8,272,330 | B1 * | 9/2012 | Gold et al. | ..... | 102/494 |
| 8,316,772 | B1 * | 11/2012 | Gold et al. | ..... | 102/519 |
| 8,408,139 | B2 * | 4/2013 | Baumann et al. | ..... | 102/491 |
| 8,522,685 | B1 * | 9/2013 | Gold et al. | ..... | 102/494 |
| 2003/0140813 | A1 * | 7/2003 | Rosenkranz et al. | ..... | 102/473 |
| 2004/0020399 | A1 * | 2/2004 | Thiesen et al. | ..... | 102/527 |
| 2007/0157843 | A1 * | 7/2007 | Roemerman et al. | ..... | 102/385 |

* cited by examiner

*Primary Examiner* — Bret Hayes

(74) *Attorney, Agent, or Firm* — Michael C. Sachs

(57) ABSTRACT

A wall breaching explosive fragmentation ammunition having a tungsten alloy nose cap with ceramic cone nose which make possible penetration into a hardened target with survivability of the warhead. The ammunition employs a unitary construction with fuze completely within the projectile's shell case. The ammunition has an external plastic rotating band which also encloses an induction antenna. The antenna may signal the fuze on a wire, through a hole in the shell case. The fuze signals may be fed through a gun barrel, then picked up on the antenna. The ammunition also employs a controlled pattern fragmentation mechanism incorporating a patterned plastic liner.

3 Claims, 1 Drawing Sheet

WALL BREACHING FRAGMENTATION PROJECTILE

U.S. GOVERNMENT INTEREST

The inventions described herein may be made, used, or licensed by or for the U.S. Government for U.S. Government purposes.

BACKGROUND OF INVENTION

There is a continuing need to provide improved small and medium caliber wall breaching explosive fragmentation ammunition to provide efficient penetration of hardened concrete, masonry and adobe walls, light armor, and further to effectively deliver the payload thereof with minimum structural damage to the ammunition's projectile. There is also a continuing need to deliver an increase in lethal area effect for such ammunition. There is certainly a need to provide a multi-functional anti-personnel, anti-materiel, penetration/airburst warhead for such ammunition, also having insensitive munition (IM), blast, and controlled fragmentation features, and also improving shock absorption mitigation characteristics of these projectiles.

BRIEF SUMMARY OF INVENTION

This invention, among its many beneficial features, utilizes a unique tungsten alloy nose cap with ceramic cone nose for a projectile which make possible greater penetration into a hardened target and survivability of its warhead. The invention also employs a unique unitary construction of a projectile with a fuze completely enclosed within the explosive payload of the projectile steel case. The invention also employs a unique fragmentation mechanism incorporating a patterned plastic liner within a fragmenting outer shell. The plastic liner also has the salutory effect of shock mitigation and insensitive munition diminution in fire hazard scenarios.

OBJECTS OF THE INVENTION

Accordingly, it is an object of the present invention to provide improved wall breaching explosive fragmentation ammunition.

Another object of the present invention is to provide efficient penetration of hardened concrete, masonry and adobe walls, light armor, and further to effectively deliver the payload thereof with minimum structural damage to an ammunition's projectile.

It is a further object of the present invention to deliver an increase in lethal area effect for wall breaching ammunition.

It is yet another object of the present invention to provide a multi-functional anti-personnel, anti-materiel, penetration/airburst warhead for wall breaching ammunition.

It is a still further object of the present invention to provide insensitive munition (IM), blast, controlled fragmentation features, and also improved shock absorption mitigation characteristics of wall breaching ammunition.

These and other objects, features and advantages of the invention will become more apparent in view of the within detailed descriptions of the invention, the claims, and in light of the following drawings wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

LIST OF DRAWINGS

DETAILED DESCRIPTION

Figure 1:
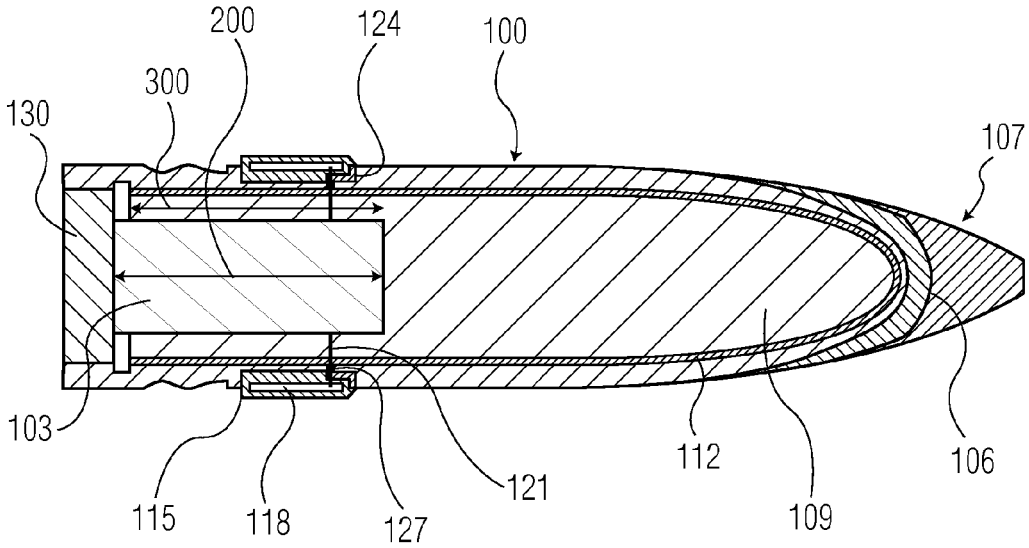
FIG. 1 shows a cross sectional view of the projectile according to this invention.
Figure 2:
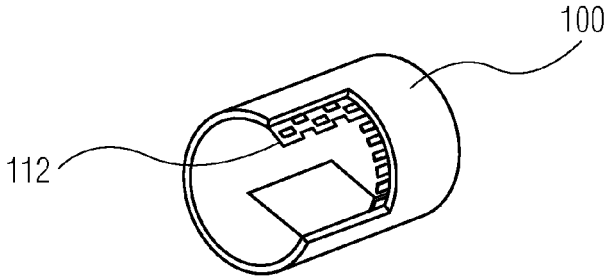
FIG. 2 shows a cutaway view of the projectile illustrating the plastic liner 112 there which is useful in fragmenting the round according to this invention.

In FIGS. 1 and 2, the invention provides a wall breaching explosive fragmentation ammunition. It also provides a multi-functional anti-personnel, anti-materiel, penetration/airburst warhead, also having insensitive munition (IM), blast, and controlled fragmentation features. It provides efficient penetration of hardened concrete, masonry and adobe walls, light armor, and effectively delivers a payload with minimum structural damage to the ammunition's projectile. Unitary case construction uses a solitary fragmentation steel shell 100 to enclose both the fuze 103 and the explosive 109. This configuration is in contrast to having the fuze in direct contact with the shell, with no explosive there inbetween, as is the case in most conventional small and mid-caliber warhead configurations. This invention approach of depositing a layer of explosive between fuze 103 and shell case 100 will allow utilization of the shell case along the entire length (200) of the fuze, and this results in an approximate 30% increase in the warhead's fragmentation lethality. The explosive layer (300) between the fuze exterior and shell case interior along the length (200) of the fuze must be sufficient to burst the shell case in that region (length 200); it should be at least 3-4 mm thick. At the fore end of the projectile is a (W) tungsten alloy nose cap 106, overlaid with a ceramic cone 107, and the projectile has a rear enclosure piece at 130. Communication to the fuze runs through electrical signals fed to the gun barrel (whose material is electrically conductive), such signals being radiated electromagnetically and effectively picked up by an induction antenna 118 deposited into a plastic rotating band 115. The induction antenna output is connected with the fuze using an electrical conductor 121 (a wire) through a hole (such as 127) in the fragmentation steel shell case. The hole in the steel case around the conductor, and the space between the rotating band and the body, is filled with low melting temperature electric insulator material 124. Hole 127 also serves as a vent (adding IM benefit) in the case of accidental fire hazard. A plastic liner 112 is deposited between the explosive 109 and the steel fragmentation case; liner 112 is fabricated from low density, low melting temperature, viscous-elastic-plastic material and assists to provide insensitive munition (IM) and controlled fragmentation functions, and also for shock absorption mitigation characteristics of the projectile. This invention can be used on small, medium, or large caliber warheads, for example. Warheads such as depicted in FIG. 1 have been seen to penetrate DRC reinforced concrete or Adobe wall and still to survive, and have been seen to deliver a 400% increase in lethal area effect.

While the invention may have been described with reference to certain embodiments, numerous changes, alterations and modifications to the described embodiments are possible without departing from the spirit and scope of the invention as defined in the appended claims, and equivalents thereof.

What is claimed is:

1. A wall breaching explosive fragmentation ammunition for launching through a gun barrel, said ammunition comprising:

a solitary steel fragmentation shell case (100) enclosing a fuze (103) having a fuze length (200), explosive (109), a rear enclosure piece (130), and a hole patterned plastic liner (112) further embedded between the explosive and an interior surface of the steel fragmentation shell case, said liner fabricated from low density, low melting temperature, viscous-elastic-plastic material, and such that a layer (300) of ammunition at least 3 to 4 mm deep is disposed between the interior surface of the shell case (100) along the length (200) of said fuze (130);

a tungsten alloy nose cap (106), said nose cap further overlaid with a ceramic cone (107), and;

a plastic rotating band (115) around the exterior of said shell case, said plastic rotating band enclosing an induction antenna (118), and;

a hole (127) through the shell case, and a wire (121) electrically connecting said induction antenna to said fuze within said shell case, and wherein;

said hale in the steel case around the wire, and also the space between the rotating band and the shell case, are filled with low melting temperature electric insulator material (124), and;

wherein communication to the fuze is accomplished through signals fed to the gun barrel, such signals then being effectively picked up electromagnetically by said induction antenna.

2. The ammunition of claim 1 wherein said fuze is cylindrical in shape and is surrounded by the explosive which is cylindrical in shape, and wherein said liner is hollow cylindrical in shape and is surrounded by said steel fragmentation shell case which is hollow cylindrical in shape.

3. The ammunition of claim 2 wherein said liner further includes patterns of rectangular holes thereon.

* * * * *